US006136146A

United States Patent [19]

Phan et al.

[11] Patent Number: 6,136,146

[45] Date of Patent: Oct. 24, 2000

[54] NON-THROUGH AIR DRIED PAPER WEB HAVING DIFFERENT BASIS WEIGHTS AND DENSITIES

[75] Inventors: Dean Van Phan, West Chester; Paul Dennis Trokhan, Hamilton, both of Ohio

[73] Assignee: The Procter & Gamble Company, Cincinnati, Ohio

[21] Appl. No.: 08/916,433

[22] Filed: Aug. 22, 1997

Related U.S. Application Data

[63] Continuation-in-part of application No. 08/710,822, Sep. 23, 1996, Pat. No. 5,804,281, which is a continuation of application No. 08/613,797, Mar. 1, 1996, Pat. No. 5,614,061, which is a continuation of application No. 08/382,551, Feb. 2, 1995, abandoned, which is a division of application No. 08/071,834, Jul. 28, 1993, Pat. No. 5,443,691, which is a continuation of application No. 07/724,551, Jun. 28, 1991, Pat. No. 5,277,761, which is a continuation-in-part of application No. 08/802,094, Feb. 19, 1997, abandoned, which is a continuation of application No. 08/601,910, Feb. 15, 1996, Pat. No. 5,654,076, which is a continuation of application No. 08/163,498, Dec. 6, 1993, Pat. No. 5,534,326, which is a continuation of application No. 07/922,436, Jul. 29, 1992, abandoned, which is a continuation-in-part of application No. 08/748,871, Nov. 14, 1996, which is a continuation-in-part of application No. 08/803,695, Feb. 21, 1997, Pat. No. 5,804,036.

[51] Int. Cl.[7] ..... D21H 15/02

[52] U.S. Cl. ..... 162/109; 162/110; 428/170; 428/171; 428/153

[58] Field of Search ..... 162/109, 110, 162/112, 113, 117; 428/174, 179, 171, 153, 154

[56] References Cited

U.S. PATENT DOCUMENTS

| | | | |
|---|---|---|---|
| 795,719 | 7/1905 | Motz . | |
| 1,616,222 | 2/1927 | Harrigan . | |
| 1,687,140 | 10/1928 | Pleyer . | |
| 1,699,760 | 1/1929 | Shermann . | |
| 2,771,363 | 11/1956 | Fish | 162/117 |
| 2,862,251 | 12/1958 | Kalwaites | 19/161 |
| 2,902,395 | 9/1959 | Hirschy et al. | 161/57 |
| 3,025,585 | 3/1962 | Griswold | 28/1 |
| 3,034,180 | 5/1962 | Greiner et al. | 19/155 |
| 3,072,511 | 1/1963 | Harwood | 154/46 |
| 3,081,500 | 3/1963 | Griswold et al. | 19/161 |
| 3,081,512 | 3/1963 | Griswold | 28/72 |
| 3,081,514 | 3/1963 | Griswold | 28/78 |
| 3,081,515 | 3/1963 | Griswold et al. | 28/78 |
| 3,159,530 | 12/1964 | Heller et al. | 162/348 |
| 3,322,617 | 5/1967 | Osborn | 162/296 |
| 3,491,802 | 1/1970 | Mortenson et al. | 139/420 |
| 3,549,742 | 12/1970 | Benz | 264/250 |
| 3,681,182 | 8/1972 | Kalwaites | 161/109 |
| 3,681,183 | 8/1972 | Kalwaites | 161/109 |
| 3,881,987 | 5/1975 | Benz | 162/116 |
| 4,191,609 | 3/1980 | Trokhan | 162/113 |
| 4,514,345 | 4/1985 | Johnson et al. | 264/22 |
| 4,529,480 | 7/1985 | Trokhan | 162/109 |
| 4,637,859 | 1/1987 | Trokhan | 162/109 |

(List continued on next page.)

FOREIGN PATENT DOCUMENTS

| | | |
|---|---|---|
| 0312 512 | 4/1989 | European Pat. Off. . |
| 1117731 | 12/1964 | United Kingdom . |
| 1008703 | 11/1965 | United Kingdom . |
| WO 91/02642 | 3/1991 | WIPO . |
| WO 96/35018 | 11/1996 | WIPO . |

*Primary Examiner*—Dean T. Nguyen
*Attorney, Agent, or Firm*—Roddy M. Bullock; Larry L. Huston; Gerry S. Gressel

[57] ABSTRACT

A non-through air dried paper web and method of making such a paper web are disclosed. The paper web includes at least two regions of different density and at least two regions of different basis weight. In one embodiment, the paper web includes a relatively high basis weight continuous network region, a plurality of discrete, relatively low basis weight regions dispersed throughout the relatively high basis weight continuous network region, and a plurality of discrete, intermediate basis weight regions circumscribed by the relatively low basis weight regions.

7 Claims, 7 Drawing Sheets

U.S. PATENT DOCUMENTS

| | | | |
|---|---|---|---|
| 4,840,829 | 6/1989 | Suzuki et al. | 428/131 |
| 4,921,034 | 5/1990 | Burgess et al. | 162/109 |
| 5,098,519 | 3/1992 | Ramasubramanian et al. | 162/109 |
| 5,126,015 | 6/1992 | Pounder | 162/206 |
| 5,245,025 | 9/1993 | Trokhan et al. | 536/561 |
| 5,277,761 | 1/1994 | Phan et al. | 162/109 |
| 5,431,786 | 7/1995 | Rasch et al. | 162/348 |
| 5,443,691 | 8/1995 | Phan et al. | 162/115 |
| 5,503,715 | 4/1996 | Trokhan et al. | 162/296 |
| 5,527,428 | 6/1996 | Trokhan et al. | 162/116 |
| 5,534,326 | 7/1996 | Trokhan et al. | 428/131 |
| 5,556,509 | 9/1996 | Trokhan et al. | 162/111 |
| 5,654,076 | 8/1997 | Trokhan et al. | 428/131 |

20

NON-THROUGH AIR DRIED PAPER WEB HAVING DIFFERENT BASIS WEIGHTS AND DENSITIES

This patent application claims priority to the following commonly assigned U.S. Patent Applications:

This application is a continuation-in-part of—U.S. patent application Ser. No. 8/710,822 now U.S. Pat. No. 5,804,281 "Cellulosic Fibrous Structures Having at Least Three Regions Distinguished by Intensive Properties, and Apparatus for and a Method of Making Such Cellulosic Fibrous Structures, filed Sep. 23, 1996 in the names of Phan et al., which is a continuation of Ser. No. 08/613,797 filed Mar. 1, 1996 now U.S. Pat. No. 5,614,061, which is a continuation of Ser. No. 08/382,551 Feb. 2 1995 now abandoned, which is a divisional of Ser. No. 08/071,834 filed Jul. 28, 1993 now U.S. Pat. No. 5,443,691, which is a continuation of Ser. No. 07/724,551 filed Jun. 28, 1991 now U.S. Pat. No. 5,277,761.

This application is a continuation-in-part of—U.S. patent application Ser. No. 08/802,094 filed Feb. 19, 1997 (now abandoned) in the name of Trokhan et al., which is a continuation of Ser. No. 08/601,910 filed Feb. 15, 1996 now U.S. Pat. No. 5,654,076, which is a continuation of Ser. No. 08/163,498 filed Dec. 6, 1993 now U.S. Pat. No. 5,534,326, which is a continuation of Ser. No. Ser. No. 07/922,436 filed Jul. 29, 1992 now abandoned.

This application is a continuation-in-part of—U.S. patent application Ser. No. 08/748,871 "Paper Web Having a Relatively Thinner Continuous Network Region and Discrete Relatively Thicker Regions in the Plane of the Continuous Network Region," filed Nov. 14, 1996 in the name of Phan; and This application is a continuation-in-part of—U.S. patent application Ser. No. 08/803,695 now U.S. Pat. No. 5,804,036 "Paper Structures Having At Least Three Regions Including Decorative Indicia Comprising Low Basis Weight Regions, filed Feb. 21, 1997 in the name of Phan et al.

This patent application incorporates by reference U.S. Pat. No. 5,534,326 issued Jul. 9, 1996 to Trokhan et al.; U.S. Pat. No. 5,245,025 issued Sep. 14, 1993 to Trokhan et al.; U.S. Pat. No. 5,277,761 issued Jan. 11, 1994 to Phan et al.; and U.S. Pat. No. 5,654,076 issued Aug. 5, 1997 to Trokhan et al.

This patent application incorporates by reference the following patent applications: U.S. patent application Ser. No. 08/748,871 "Paper Web Having a Relatively Thinner Continuous Network Region and Discrete Relatively Thicker Regions in the Plane of the Continuous Network Region," filed Nov. 14, 1996 in the name of Phan; U.S. patent application Ser. No. 08/803,695 now U.S. Pat. No. 5,804,036 "Paper Structures Having At Least Three Regions including Decorative Indicia Comprising Low Basis Weight Regions, filed Feb. 21, 1997 in the name of Phan et al.

FIELD OF THE INVENTION

The present invention relates to cellulosic fibrous structures having different basis weights and densities, and more particularly to non-through air dried paper having different basis weights and densities.

BACKGROUND OF THE INVENTION

Cellulosic fibrous structures, such as paper, are well known in the art. Frequently, it is desirable to have regions of different basis weights within the same cellulosic fibrous product. The two regions serve different purposes. The regions of higher basis weight impart tensile strength to the fibrous structure. The regions of lower basis weight may be utilized for economizing raw materials, particularly the fibers used in the papermaking process and to impart absorbency to the fibrous structure. In a degenerate case, the low basis weight regions may represent apertures or holes in the fibrous structure. However, it is not necessary that the low basis weight regions be apertured.

The properties of absorbency and strength, and further the property of softness, become important when the fibrous structure is used for its intended purpose. Particularly, the fibrous structure described herein may be used for facial tissues, toilet tissue, paper towels, bibs, and napkins, each of which is in frequent use today. If these products are to perform their intended tasks and find wide acceptance, the fibrous structure must exhibit and maximize the physical properties discussed above. Wet and Dry Tensile strengths are measures of the ability of a fibrous structure to retain its physical integrity during use. Absorbency is the property of the fibrous structure which allows it to retain contacted fluids. Both the absolute quantity of fluid and the rate at which the fibrous structure will absorb such fluid must be considered when evaluating one of the aforementioned consumer products. Further, such paper products have been used in disposable absorbent articles such as sanitary napkins and diapers.

Attempts have been made in the art to provide paper having two different basis weights, or to otherwise rearrange fibers. Examples include U.S. Pat. No. 795,719 issued Jul. 25, 1905 to Motz; U.S. Pat. No. 3,025,585 issued Mar. 20, 1962 to Griswold; U.S. Pat. No. 3,034,180 issued May 15, 1962 to Greiner et al; U.S. Pat. No. 3,159,530 issued Dec. 1, 1964 to Heller et al; U.S. Pat. No. 3,549,742 issued Dec. 22, 1970 to Benz; and U.S. Pat. No. 3,322,617 issued May 30, 1967 to Osborne.

Separately, there is a desire to provide tissue products having both bulk and flexibility, such as with through air drying (TAD). Improved bulk and flexibility may be provided through bilaterally staggered compressed and uncompressed zones, as shown in U.S. Pat. No. 4,191,609 issued Mar. 4, 1980 to Trokhan, which patent is incorporated herein by reference.

Several attempts to provide an improved foraminous member for making such cellulosic fibrous structures are known, one of the most significant being illustrated in U.S. Pat. No. 4,514,345 issued Apr. 30, 1985 to Johnson et al., which patent is incorporated herein by reference. Johnson et al. teaches hexagonal elements attached to the framework in a batch liquid coating process.

Another approach to making tissue products more consumer preferred is to dry the paper structure to impart greater bulk, tensile strength, and burst strength to the tissue products. Examples of paper structures made in this manner are illustrated in U.S. Pat. No. 4,637,859 issued Jan. 20, 1987 to Trokhan, which patent is incorporated herein by reference. U.S. Pat. No. 4,637,859 shows discrete dome shaped protuberances dispersed throughout a continuous network, and is incorporated herein by reference. The continuous network can provide strength, while the relatively thicker domes can provide softness and absorbency.

One disadvantage of the web disclosed in U.S. Pat. No. 4,637,859, is that drying such a web can be relatively energy intensive and expensive, and typically involves the use of through air drying equipment. In addition, the papermaking method disclosed in U.S. Pat. No. 4,637,859 can be limited with respect to the speed at which the web can be finally dried on the Yankee dryer drum. This limitation is thought to be due, at least in part, to the pattern imparted to the web prior to transfer of the web to the Yankee drum. In particular, the discrete domes described in U.S. Pat. No. 4,637,859 may not be dried as efficiently on the Yankee surface as is the continuous network described in U.S. Pat. No. 4,637,859. Accordingly, for a given consistency level and basis weight, the speed at which the Yankee drum can be operated is limited.

Conventional tissue paper made by pressing a web with one or more press felts in a press nip can be made at relatively high speeds. The conventionally pressed paper, once dried, can then be embossed to pattern the web, and to increase the macro-caliper of the web. For example, embossed patterns formed in tissue paper products after the tissue paper products have been dried are common.

However, embossing processes typically impart a particular aesthetic appearance to the paper structure at the expense of other properties of the structure. In particular, embossing a dried paper web disrupts bonds between fibers in the cellulosic structure. This disruption occurs because the bonds are formed and set upon drying of the embryonic fibrous slurry. After drying the paper structure, moving fibers normal to the plane of the paper structure by embossing breaks fiber to fiber bonds. Breaking bonds results in reduced tensile strength of the dried paper web. In addition, embossing is typically done after creping of the dried paper web from the drying drum. Embossing after creping can disrupt the creping pattern imparted to the web. For instance, embossing can eliminate the creping pattern in some portions of the web by compacting or stretching the creping pattern. Such a result is undesirable because the creping pattern improves the softness and flexibility of the dried web.

Accordingly, one object of the present invention is to provide a paper and method for making a multi-region paper web wherein the web has a predetermined pattern of relatively high and relatively low density regions, yet can be dried with relatively lower energy and expense.

Another object of the present invention is to provide a method for making a multi-region paper having at least two, and preferably at least three different basis weights.

Another object of the present invention is to provide a non-through air dried paper web having different basis weights and different densities.

Another object of the present invention is to provide a paper web having a visually distinct pattern provided by a combination and/or inteference of two different repeating, nonrandom patterns.

BRIEF SUMMARY OF THE INVENTION

The present invention provides a non-through air dried paper web comprising at least two regions of different density and at least two regions of different basis weight.

The paper web can include a relatively high density, essentially continuous network region, and a plurality of discrete, spaced apart relatively low density regions dispersed throughout the relatively high density continuous network region.

The paper web can also comprise a relatively high basis weight, essentially continuous network region. The paper can further comprise a plurality of discrete relatively low basis weight regions dispersed throughout the relatively high basis weight continuous network, and a plurality of discrete, intermediate basis weight regions, wherein the intermediate basis weight regions are generally circumscribed by the relatively low basis weight regions.

In one embodiment of the present invention, the paper web has at least two regions of different basis weight disposed in a first nonrandom, repeating pattern, and at least two regions of different density disposed in a second nonrandom, repeating pattern; wherein the first and second patterns combine to provide a third visually distinguishable pattern, the third pattern being different from the first and second patterns.

The present invention also provides a method of producing a non-through air dried paper web having at least two regions of different basis weight and at least two regions of different density. The method includes the steps of: providing a plurality of fibers suspended in a liquid carrier; providing a fiber retentive forming element having liquid pervious zones; depositing the fibers and the liquid carrier onto the forming element; draining the liquid carrier through the forming element in at least two simultaneous stages to form a web having at least two regions of different basis weight; providing a web support apparatus comprising a web patterning surface and a dewatering felt layer; transferring the web from the forming element to the web patterning surface of the web support apparatus; selectively densifying a portion of the web to provide the web with at least two different densities; and drying the web.

The step of selectively densifying a portion of the web comprises providing a continuous network, relatively high density region and a plurality of discrete, relatively low density regions dispersed throughout the continuous network, relatively high density region. The step of draining the liquid carrier through the forming element can include forming a web having a relatively high basis weight, continuous network and a plurality of discrete, relatively low basis weight regions dispersed throughout the relatively high basis weight continuous network. In one embodiment, the step of draining the liquid carrier through the forming element comprises forming a web having a relatively high basis weight, continuous network region; a plurality of discrete, relatively low basis weight regions dispersed throughout the relatively high basis weight, continuous network region, and a plurality of discrete, intermediate basis weight regions circumscribed by the relatively low basis weight regions.

BRIEF DESCRIPTION OF THE DRAWINGS

While the Specification concludes with claims particularly pointing out and distinctly claiming the present invention, it is believed the invention is better understood from the following description taken in conjunction with the associated drawings, in which like elements are designated by the same reference numeral and:

DETAILED DESCRIPTION OF THE INVENTION

Figure 1:
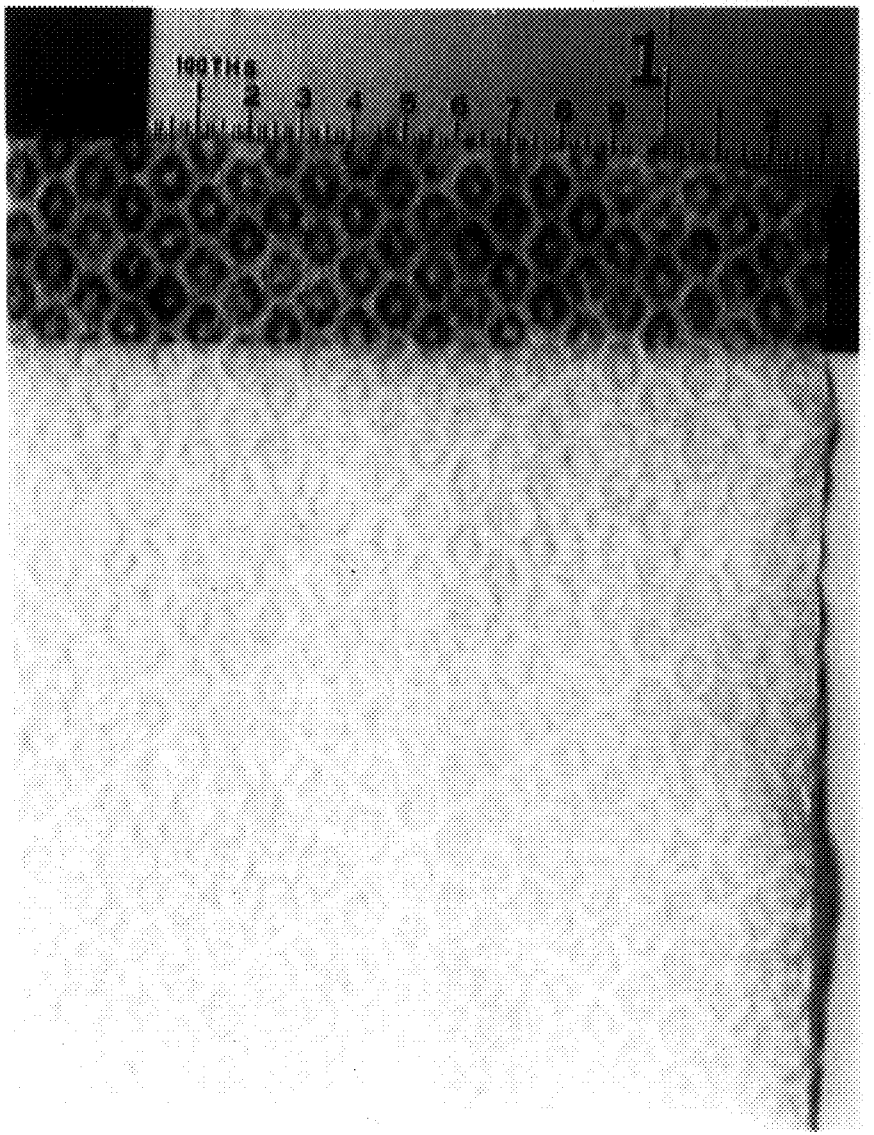
FIG. 1 is a photograph of a paper web made according to the present invention, wherein a portion of the paper web is positioned over a black background and wherein another portion of the paper web is positioned over a white background. The scale in FIG. 1 has divisions of 1/100 of an inch.
Figure 2:
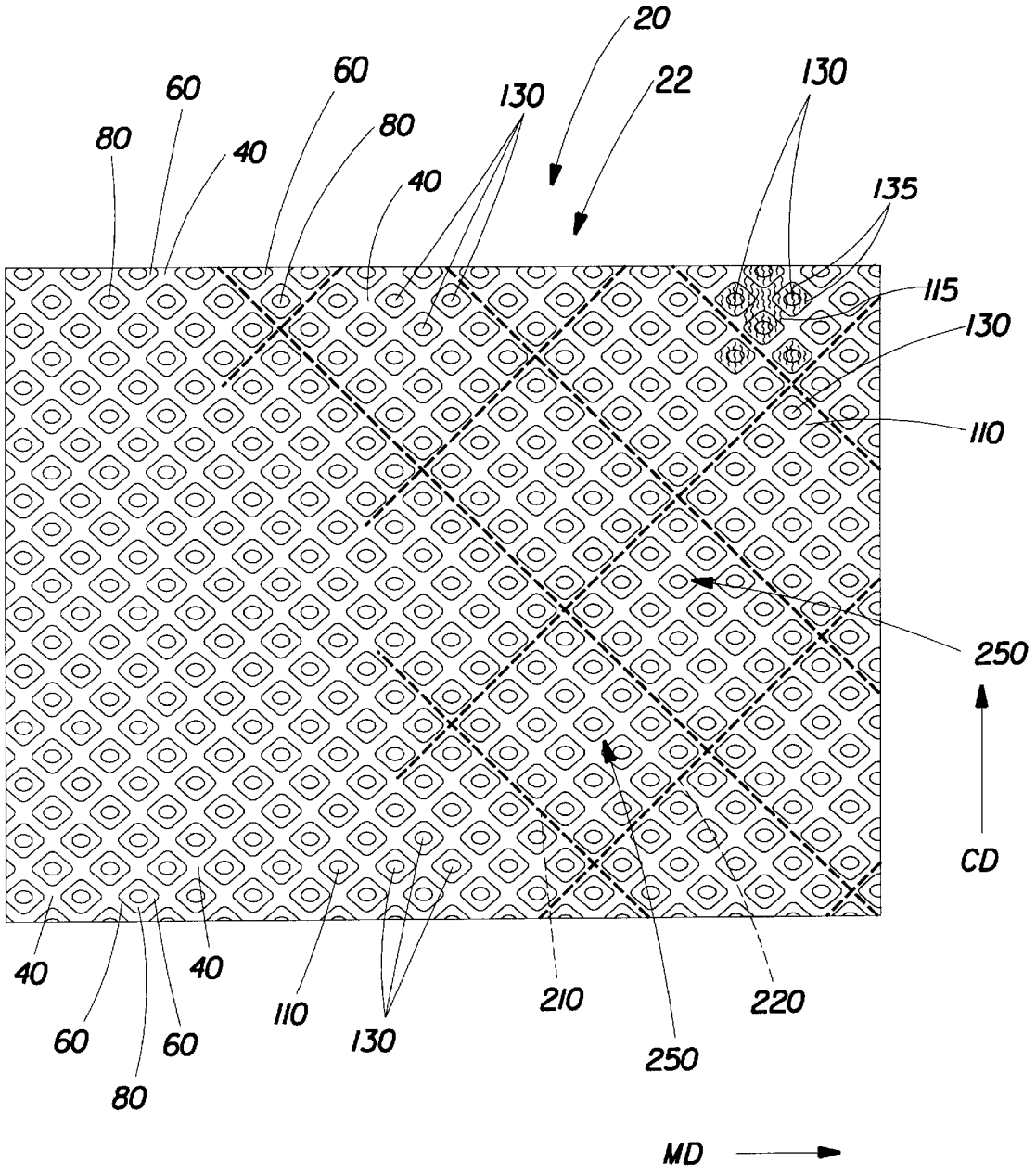
FIG. 2 is a schematic illustration of a paper web of the type shown in FIG. 1.
Figure 3:
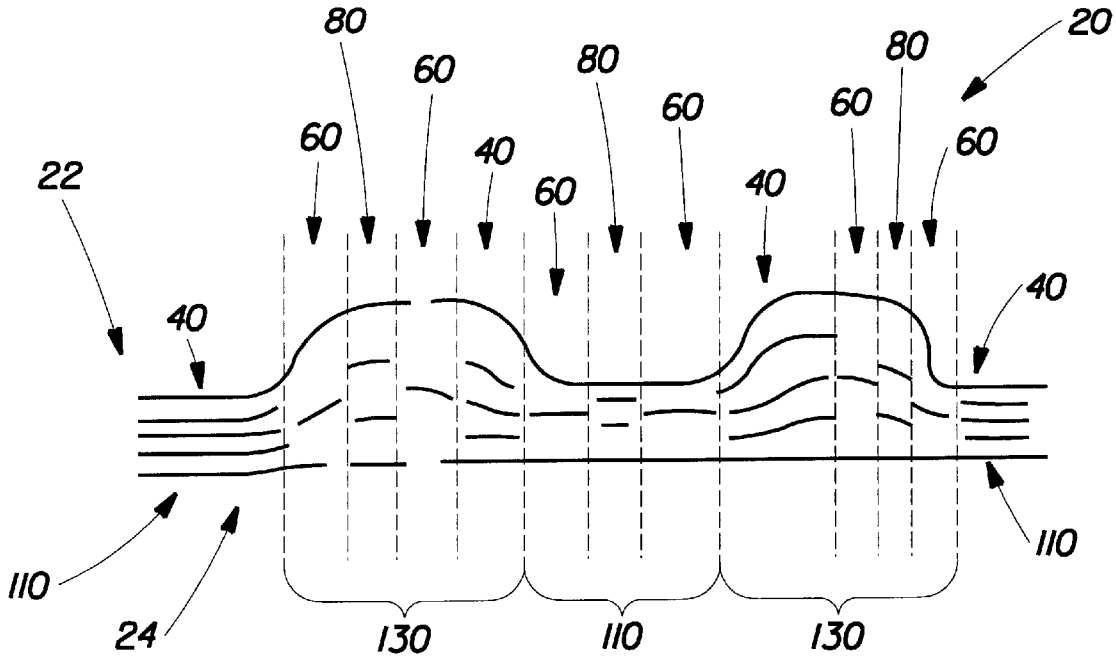
FIG. 3 is a cross-sectional, schematic illustration of a paper web of the type shown in FIG. 2.

FIG. 1 is a photograph of a paper web 20 made according to the present invention. FIG. 2 is a schematic illustration of the image in FIG. 1. FIG. 3 is a cross-sectional illustration of a paper web 20 of the type shown in FIG. 1.

The paper web 20 is wetlaid, and is substantially free of dry embossments. The paper web 20, as shown in FIG. 1, is a non-through air dried web. By "non-through air dried" it is meant that the web is not pre-dried on a drying fabric by directing heated air through selected portions of the web and the drying fabric.

Referring to FIGS. 1–3, the paper web 20 has first and second oppositely facing surfaces 22 and 24, respectively. The paper web 20 comprises at least two regions having different densities disposed in a nonrandom, repeating pattern. The paper web 20 also comprises at least two regions having different basis weights disposed in a nonrandom, repeating pattern.

The line density through the web thickness in FIG. 3 is used to schematically illustrate the relative basis weights of different portions of the web. The portions of the web illustrated with 5 lines through the web thickness represent relatively high basis weight regions, the portions of the web illustrated with 3 lines through the web thickness represent relatively low basis weight regions, and the portions of the web illustrated with 4 lines through the web thickness represent intermediate basis weight regions.

In the embodiment shown in FIGS. 1–3, the paper web 20 is formed to have a relatively high basis weight, essentially continuous network 40, and a plurality of discrete, spaced apart, relatively low basis weight regions 60 dispersed throughout the network 40. In FIG. 1, the different basis weight regions are visable in a portion of the web positioned over a black background.

In the embodiment shown, the paper web 20 further comprises a plurality of discrete, intermediate basis weight regions 80. Each intermediate basis weight region 80 is generally circumscribed by a relatively low basis weight region 60. Each intermediate basis weight region 80 is paired with a relatively low basis weight region 60, and is separated from the relatively high basis weight, continuous network 40 by its associated relatively low basis weight region 60.

The relatively low basis weight regions 60 can have the characteristic that the regions 60 comprise radially oriented fibers extending from the intermediate basis weight regions 80 to the relatively high basis weight, essentially continuous network 40. Alternatively, the region 60 can comprise fibers which are non-radially oriented. In yet another alternative embodiment, the paper web 20 does not have an intermediate basis weight region 80, but instead has just two basis weight regions corresponding to the regions 40 and 60.

The paper web 20 of the present invention is selectively densified to provide at least two regions of different density. In the embodiment shown in FIGS. 1–3, the paper web 20 is selectively densified to provide a relatively high density, essentially continuous network region 110 and a plurality of discrete, relatively low density regions 130 dispersed throughout the continuous network region 110. The regions 130 are relatively thicker than the region 110. In FIG. 1, the network region 110 and the relatively low density regions 130 are visable in the portion of the web positioned over a white background.

The number of relatively low basis weight regions 60 per unit area can be the same as, or different than, the number of relatively low density regions 130 per unit area. For instance, the number of relatively low basis weight regions 60 per unit area can be less than, or alternatively greater than, the number of low density regions 130 per unit area.

In the embodiment shown in FIGS. 1 and 2, the number of relatively low basis weight regions 60 per unit area of the web is greater than the number of relatively low density regions 130 per unit area of the web.

The number of regions 60 per unit area can be at least 25 percent greater than the number of regions 130 per unit area. The paper web can comprise between about 10 and about 400 of the regions 60 per square inch, and the paper web 20 can comprise between about 8 and about 350 of the regions 130 per square inch. In one embodiment, the paper web comprises between about 90 and about 110 of the regions 60 per square inch, and between about 60 and about 80 of the regions 130 per square inch.

In the embodiment shown in FIG. 2, the shape defined by the perimeter of the regions 130 is generally the same as the shape defined by the perimeter of the regions 60. The regions 60 and 130 each have a perimeter defining a shape which is elongated in machine direction. Alternatively, the regions 60 and 130 could have different shapes.

The paper web 20 shown in FIGS. 1 and 2 have the characteristic that the regions of the different basis weight are disposed in a first nonrandom, repeating pattern, and the regions of different density are disposed in a second nonrandom, repeating pattern. These first and second patterns combine to provide a third visually distinguishable pattern which is different from the first and second patterns.

This third pattern is visable in FIG. 1, and is indicated in dotted outline in FIG. 2. The third pattern comprises a plurality of first striations 210, and a plurality of second striations 220. In FIGS. 1 and 2, the first striations intersect the second striations 220, and the first and second striations 210 and 220 extend diagonally with respect to the machine and cross-machine directions of the paper. The third pattern provides a plurality of generally diamond shaped cells 250.

Without being limited by theory, it is believed that the third visually distinguishable pattern is provided by interference between the patterns of density and basis weight. In particular, the third pattern is believed to be related to Moire or Moire-like interference of the repeating patterns of density and basis weight.

Without being limited by theory, it is believed that one or both the first and second patterns can be varied to provide a different third pattern. For instance, the size, shape, or spacing of one or both of the regions 60 and 130 can be varied to provide a different third pattern. Alternatively, the relative orientation of the first and second patterns can varied to provide a different third pattern. For instance, the first pattern can be rotated relative to the second pattern to provide a different third pattern.

As shown in FIGS. 1 and 2, the each cell 250 encloses a number of the discrete basis weight regions 60 and 80. Each cell 250 also encloses a number of discrete density regions 130. The cells 250 of the third pattern have a much larger repeat pattern than the repeat pattern of the different density regions and the repeat pattern of the different of the different basis weight regions. Accordingly, paper webs according to the present invention have the advantage that they provide a large scale, visually discernible pattern without the need for embossing, and without the need for making large scale changes to basis weight or density of the paper web.

The non-through air dried paper web 20 made according to the present invention can have a smoothness value of less than about 1000 on at least one of the oppositely facing surfaces of the web. In FIG. 3, the smoothness value of surface 24 is less than the smoothness value of surface 22. The smoothness value of surface 24 is preferably less than about 1000. The smoothness value of the surface 22 can be greater than about 1100. In particular, the paper web 20 can have a surface smoothness ratio greater than about 1.10, where the surface smoothness ratio is the value of the surface smoothness of surface 22 divided by the value of the smoothness value of surface 24.

In one embodiment, the surface 24 of the web 20 can have a surface smoothness value of less than about 960, and the opposite surface 22 can have a surface smoothness value of at least about 1150.

The method for measuring the value of the surface smoothness of a surface is described below under "Surface Smoothness." The value of surface smoothness for a surface increases as the surface becomes more textured and less smooth. Accordingly, a relatively low value of surface smoothness indicates a relatively smooth surface.

The basis weights of the regions 40, 60, and 80 can be measured using the procedure for measuring basis weights of regions in a paper web, as set forth in U.S. Pat. No. 5,503,715 issued Apr. 2, 1996 to Trokhan et al., which patent is incorporated herein by reference.

The basis weight of the region 40 is preferably at least about 25 percent greater than the basis weight of the region 80, and the basis weight of the region 80 is preferably at least about 25 percent greater than the basis weight of the region 60.

The continuous network region 110 and the discrete regions 130 can both be foreshortened, such as by creping or wet microcontraction. In FIG. 2, the crepe ridges of the continuous network region 110 are designated by numeral 115, and extend in a generally cross-machine direction. Similarly, the discrete, relatively lower density and relatively thicker regions 130 can also be foreshortened to have crepe ridges 135. The crepe ridges 115 and 135 are shown on only a portion of the paper web 20 in FIG. 2, for clarity. U.S. Pat. No. 4,440,597 issued Apr. 3, 1984 to Wells et al. is incorporated herein by reference for the purpose of disclosing wet microcontraction.

The continuous network region 110 can be a relatively high density, macroscopically monoplanar continuous network region of the type disclosed in U.S. Pat. No. 4,637,859, which patent is incorporated herein by reference. The relatively lower density and relatively thicker regions 130 can be bilaterally staggered, as disclosed in U.S. Pat. No. 4,637,859. However, the regions 130 are preferably not domes of the type shown in U.S. Pat. No. 4,637,859. The regions 130 are disposed in the plane of the continuous network region 110, as disclosed in U.S. patent application Ser. No. 08/748,871 "Paper Web Having A Relatively Thinner Continuous Network Region & Discrete Relatively Thicker Regions In the Plane of the Continuous Network Region, filed Nov. 14, 1996 in the name of Phan, which application is incorporated herein by reference.

The paper web 20 having the relatively smooth surface 24 can be useful in making a multiple ply tissue having smooth outwardly facing surfaces. For instance, two or more webs 20 can be combined to form a multiple ply tissue, such that the two outwardly facing surfaces of the multiple ply tissue comprise the surfaces 24 of the webs 20, and the surfaces 22 of the outer plies face inwardly. Alternatively, a two ply paper structure can be made by joining a web 20 of the present invention with a conventionally formed and dried paper web. The web 20 can be joined to the conventional paper web such that the surface 24 faces outwardly.

The paper web 20 can have a sheet basis weight (macroscopic as compared to the basis weights of the individual regions 40, 60,80) of about 10 to about 70 grams per square meter.

Papermaking Method Description

Figure 4:
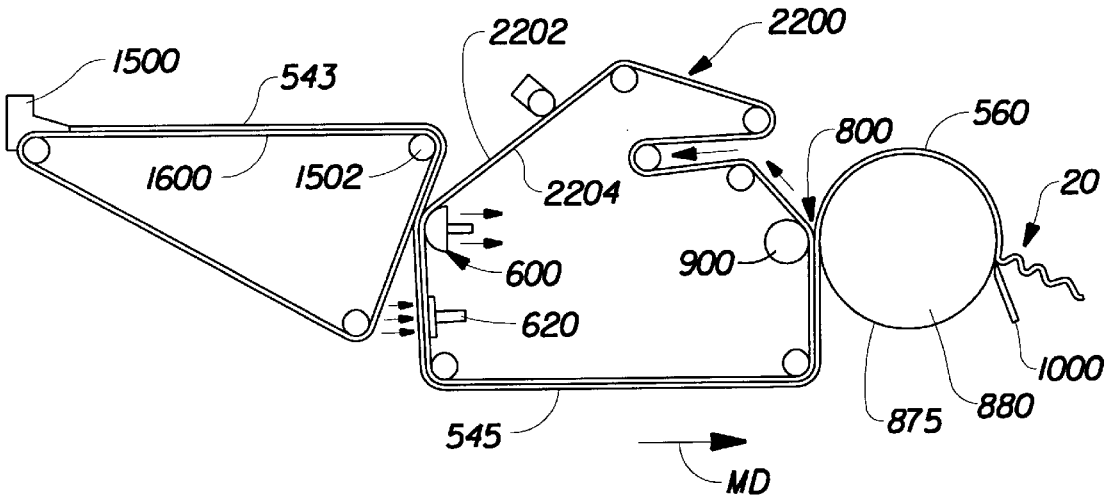
FIG. 4 is a schematic illustration of a paper machine which can be used to make the paper web of the present invention.

A paper structure 20 according to the present invention can be made with the papermaking apparatus shown in FIG. 4. The method of making the paper structure 20 of the present invention is initiated by providing a plurality of fibers suspended in a liquid carrier, such as an aqueous dispersion of papermaking fibers in the form of a slurry, and depositing the slurry of papermaking fibers from a headbox 1500 onto a fiber retentive forming element 1600. The forming element 1600 is in the form of a continuous belt in FIG. 4. The slurry of papermaking fibers is deposited on the forming element 1600, and water is drained from the slurry through the forming element 1600 to form an embryonic web of papermaking fibers 543 supported by the forming element 1600. The slurry of papermaking fibers can include relatively long fibers having an average fiber length of greater than or equal to 2.0 mm, and relatively short fibers having an average fiber length of less than 2.0 mm. For instance, the relatively long fibers can comprise softwood fibers, and the relatively short fibers can comprise hardwood fibers. Hardwood and softwood fibers are discussed in more detail below.

Figure 5:
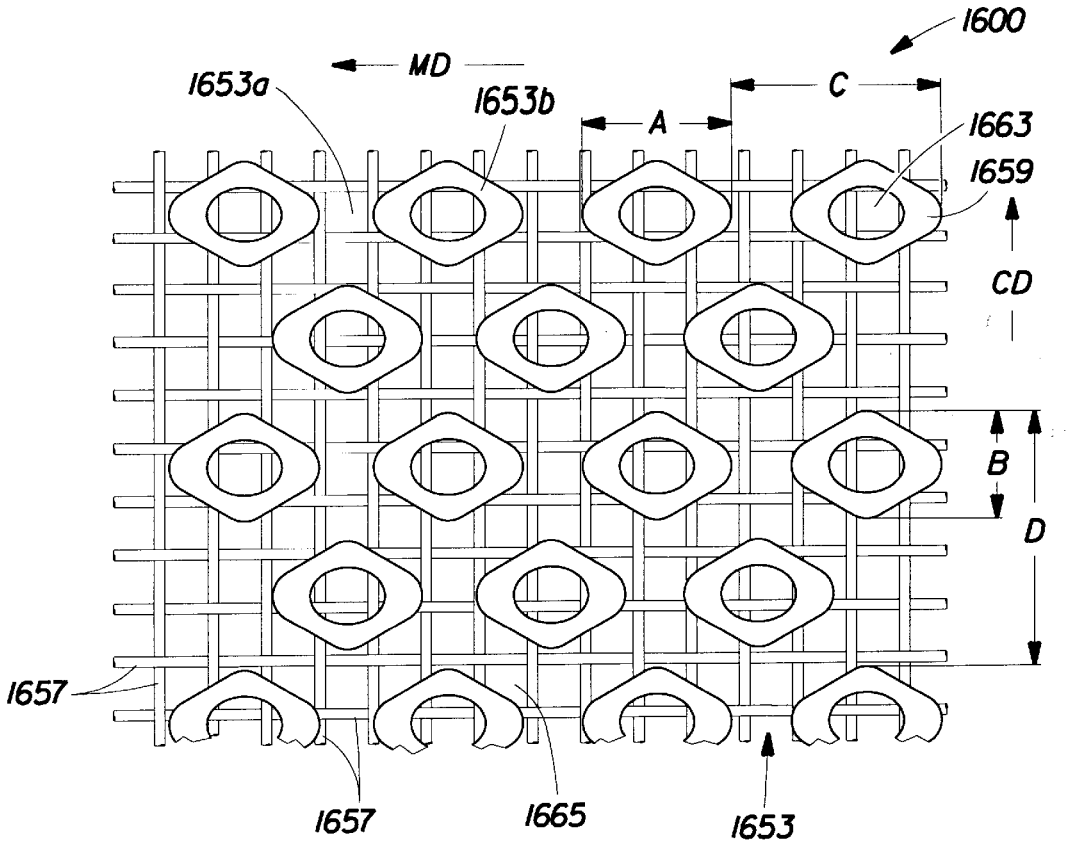
FIG. 5 is a fragmentary top plan view of a forming element having discrete protuberances and apertures extending through the protuberances.
Figure 6:
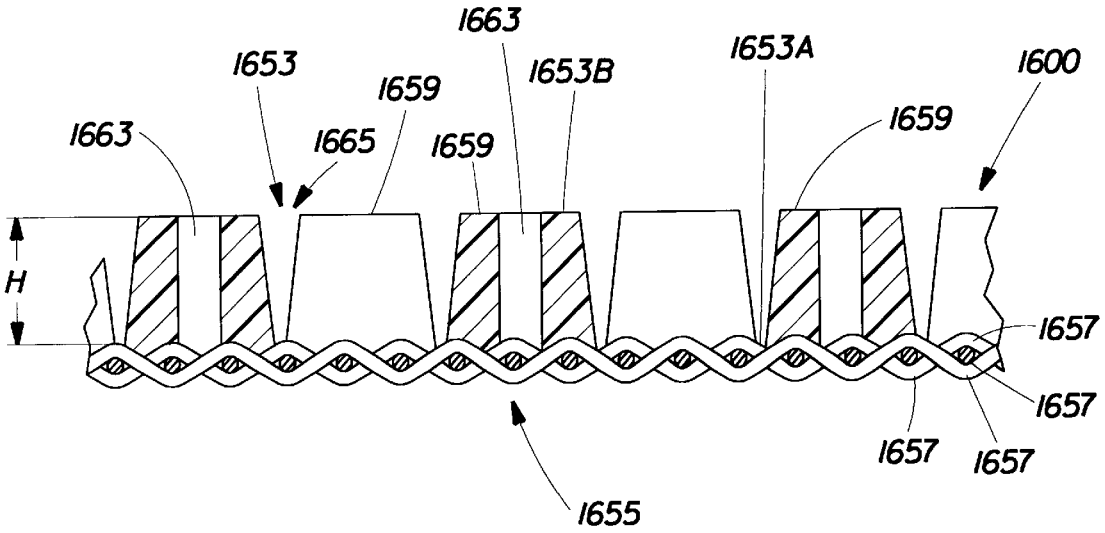
FIG. 6 is a cross-sectional illustration of the forming element show in FIG. 5.

FIGS. 5 and 6 show the forming element 1600. The forming element 1600 has two mutually opposed faces , a first face 1653, and a second face 1655. The first face 1653 is the surface of the forming element 1600 which contacts the fibers of the web being formed. The first face 1653 has two distinct regions 1653*a* and 1653*b* The forming element 1600 has flow restriction members in the form of protuberances 1659 which form the low basis weight regions 60. The protuberances 1659 are spaced apart to provide intermediate flow annuluses 1665. The intermediate flow portions 1665 form the high basis weight regions 40.

The protuberances 1659 can each have an aperture 1663 which extends through the protuberance 1659. The apertures 1663 provide the intermediate basis weight regions 80.

The forming element 1600 shown comprises a patterned array of protuberances 1659 joined to a reinforcing structure 1657, which may comprise a foraminous element, such as a woven screen or other apertured framework. The reinforcing structure 1657 is substantially fluid pervious.

The flow resistance of the aperture 1663 is different from, and typically greater than the flow resistance of the intermediate flow annuluses 1665 between adjacent protuberances 1659. Therefore, typically more of the liquid carrier will drain through the annuluses 1665 than through the apertures 1663. The intermediate flow annuluses 1665 and the apertures 1663 respectively define high flow rate and low flow rate zones in the forming element 1600.

The difference in flow rates through the zones is referred to as "staged draining." The staged draining provided by the forming element 1600 can be used to deposit different amounts of fibers in preselected portions of the paper web 20. In particular, the high basis weight region 40 will occur in a nonrandom, repeating pattern substantially corresponding to the relatively high flow rate zones (the annuluses 1665). The intermediate basis weight regions 80 will occur in a nonrandom, repeating pattern substantially corresponding to the relatively lower flow rate zones (the apertures 1663), and the relatively low basis weight regions 60 will occur in a nonrandom, repeating pattern substantially corresponding to the zero flow rate zone provided by the protuberances 1659.

Suitable constructions for the forming element 1600 are disclosed in U.S. Pat. No. 5,534,326 issued Jul. 9, 1996 to Trokhan et al., and U.S. Pat. No. 5,245,025 issued Sep. 14, 1993, which patents are incorporated herein by reference.

The forming element 1600 can have between about 10 and about 400 protuberances per square inch. In one embodiment, the forming element can have between about 90 and 110 protuberances per square inch.

In one embodiment, the forming element 1600 can have about 100 protuberances 1659 per square inch. The protuberances 1659 can have the shape shown in FIG. 5, and can have an MD (machine direction) dimension A of 0.105 inch, a CD (cross machine direction) dimension B of about 0.074 inch, a machine direction spacing C of 0.136 inch, and a cross-machine direction spacing D of 0.147 inch. The minimum spacing E between adjacent protuberances can be 0.029 inch. The protuberances 1659 can have a height H of less than about 0.010 inch. The apertures 1663 can have an elliptical shape with a major axis parallel to the machine direction of about 0.052 inch and a minor axis of about 0.037 inch.

The top surface of the protuberances 1659 can provide about 35 percent of the projected area of the forming element 1600, as viewed in FIG. 5. The apertures 1663 can provide about 15 percent of the projected area of the forming element 1600 as viewed in FIG. 5. The annuluses 1665 provide about 50 percent of the projected area of the forming element 1600 as viewed in FIG. 5.

It is anticipated that wood pulp in all its varieties will normally comprise the paper making fibers used in this invention. However, other cellulose fibrous pulps, such as cotton liners, bagasse, rayon, etc., can be used and none are disclaimed. Wood pulps useful herein include chemical pulps such as Kraft, sulfite and sulfate pulps as well as mechanical pulps including for example, ground wood, thermomechanical pulps and Chemi-ThermoMechanical Pulp (CTMP). Pulps derived from both deciduous and coniferous trees can be used. Alternatively, other non cellulosic fibers, such as synthetic fibers, can be used.

Both hardwood pulps and softwood pulps, either separately or together may be employed. The hardwood and softwood fibers can be blended, or alternatively, can be deposited in layers to provide a stratified web. U.S. Pat. No. 4,300,981 issued Nov. 17, 1981 to Carstens and U.S. Pat. No. 3,994,771 issued Nov. 30, 1976 to Morgan et al. are incorporated herein by reference for the purpose of disclosing layering of hardwood and softwood fibers.

The paper furnish can comprise a variety of additives, including but not limited to fiber binder materials, such as wet strength binder materials, dry strength binder materials, and chemical softening compositions. Suitable wet strength binders include, but are not limited to, materials such as polyamide-epichlorohydrin resins sold under the trade name of KYMENE® 557H by Hercules Inc., Wilmington, Del. Suitable temporary wet strength binders include but are not limited to synthetic polyacrylates. A suitable temporary wet strength binder is PAREZ® 750 marketed by American Cyanamid of Stanford, Conn.

Suitable dry strength binders include materials such as carboxymethyl cellulose and cationic polymers such as ACCO® 711. The CYPRO/ACCO family of dry strength materials are available from CYTEC of Kalamazoo, Mich.

The paper furnish deposited on the forming element 1600 can comprise a debonding agent to inhibit formation of some fiber to fiber bonds as the web is dried. The debonding agent, in combination with the energy provided to the web by the dry creping process, results in a portion of the web being debulked. In one embodiment, the debonding agent can be applied to fibers forming an intermediate fiber layer positioned between two or more layers. The intermediate layer acts as a debonding layer between outer layers of fibers. The creping energy can therefore debulk a portion of the web along the debonding layer.

As a result, the web can be formed to have a relatively smooth surface for efficient drying on a heated drying surface, such as the heated drying surface of a Yankee drying drum. Yet, because of the rebulking at the creping blade, the dried web can also have differential density regions, including a continuous network relatively high density region, and discrete relatively low density regions which are created by the creping process.

Suitable debonding agents include chemical softening compositions such as those disclosed in U.S. Pat. No. 5,279,767 issued Jan. 18, 1994 to Phan et al. Suitable biodegradable chemical softening compositions are disclosed in U.S. Pat. No. 5,312,522 issued May 17, 1994 to Phan et al. U.S. Pat. Nos. 5,279,767 and 5,312,522 are incorporated herein by reference. Such chemical softening compositions can be used as debonding agents for inhibiting fiber to fiber bonding in one or more layers of the fibers making up the web.

One suitable softener for providing debonding of fibers in one or more layers of fibers forming the web 20 is a papermaking additive comprising DiEster Di(Touch Hardened) Tallow Dimethyl Ammonium Chloride. A suitable softener is ADOGEN® brand papermaking additive available from Witco Company of Greenwich, Conn.

The embryonic web 543 is preferably prepared from an aqueous dispersion of papermaking fibers, though dispersions in liquids other than water can be used. The fibers are dispersed in the carrier liquid to have a consistency of from about 0.1 to about 0.3 percent. The percent consistency of a dispersion, slurry, web, or other system is defined as 100 times the quotient obtained when the weight of dry fiber in the system under consideration is divided by the total weight of the system. Fiber weight is always expressed on the basis of bone dry fibers.

The embryonic web 543 can be formed in a continuous papermaking process, as shown in FIG. 4, or alternatively, a batch process, such as a handsheet making process can be used. After the dispersion of papermaking fibers is deposited onto the forming element 1600, the embryonic web 543 is formed by removal of a portion of the aqueous dispersing medium through the forming element 1600 by techniques well known to those skilled in the art. Vacuum boxes, forming boards, hydrofoils, and the like are useful in effecting water removal from the aqueous dispersion of papermaking fibers to form embryonic web 543.

Referring back to FIG. 6, the height H can be less than about 0.010 inch in order to provide an generally monoplanar embryonic web 543 having substantially smooth first and second surfaces. (The first and second surface are designated 547 and 549 in FIG. 8).

The next step in making the paper web 20 comprises transferring the embryonic web 543 from the forming element 1600 to the web support apparatus 2200, and supporting the transferred web (designated by numeral 545 in FIG. 4) on the first side 2202 of the apparatus 2200. The embryonic web preferably has a consistency of between about 5 and about 20 percent at the point of transfer to the web support apparatus 2200.

Figure 7:
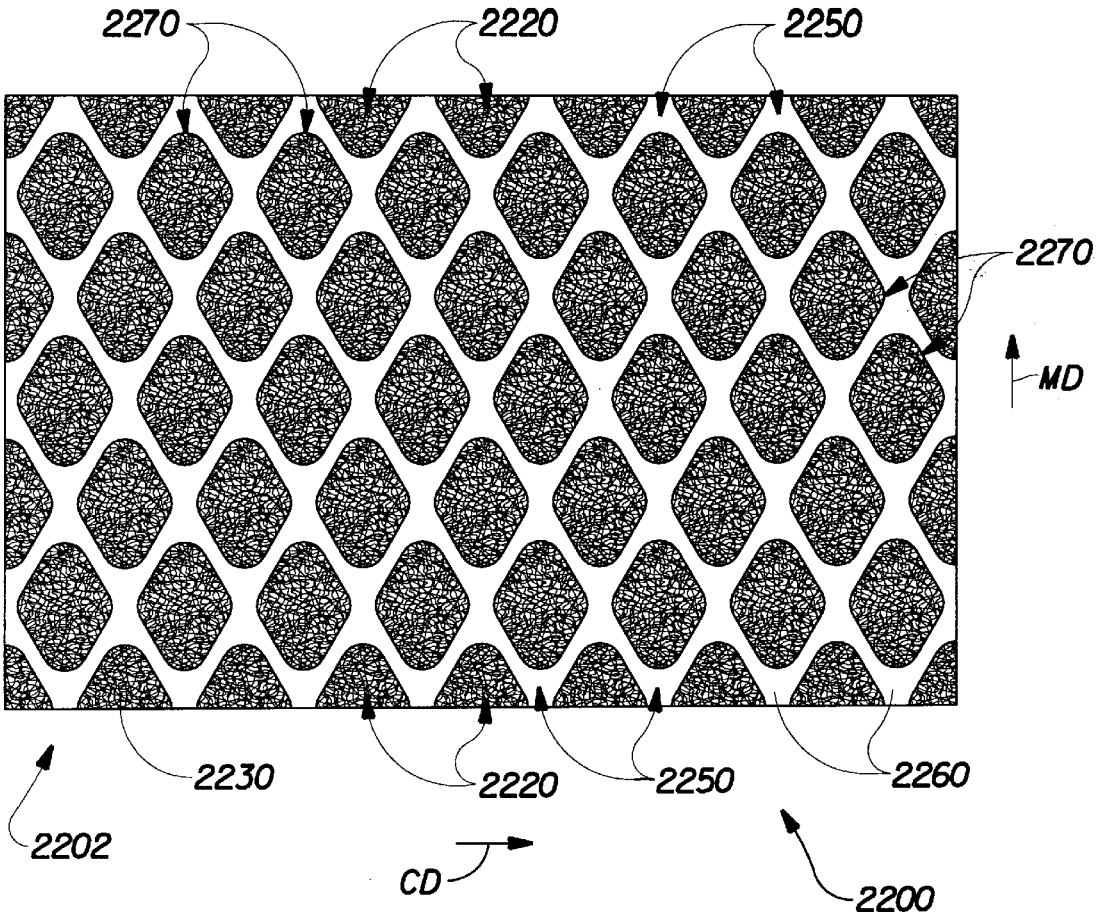
FIG. 7 is a fragmentary top plan view illustration of a portion of the sheet side of a web support apparatus.
Figure 8:
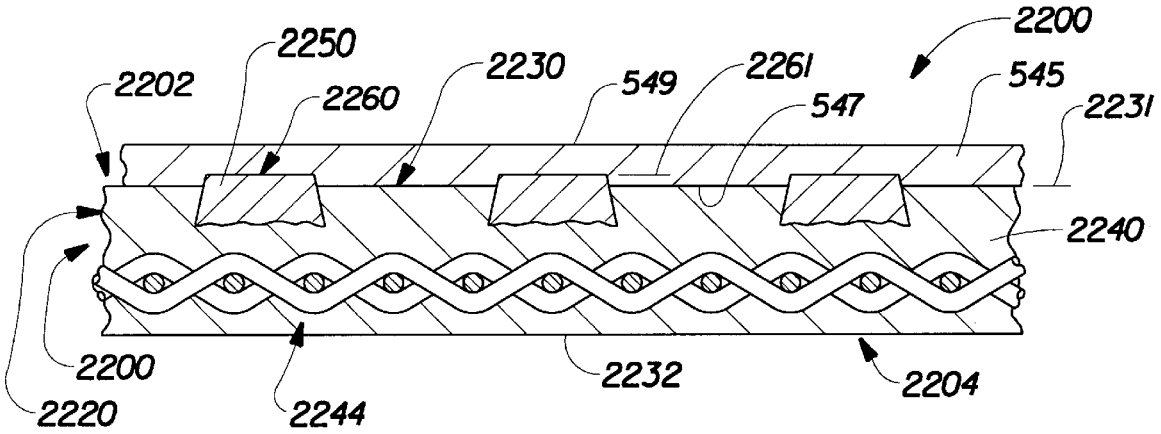
FIG. 8 is a cross-sectional schematic illustration showing the paper web transferred to the web support apparatus of the type shown in FIG. 7 to provide a paper web having a first surface conformed to the apparatus and a second substantially smooth surface.

Referring to FIGS. 7–8, the web support apparatus 2200 comprises a dewatering felt layer 2220 and a web patterning layer 2250. The web support apparatus 2200 can be in the form of a continuous belt for drying and imparting a pattern to a paper web on a paper machine. The web support apparatus 2200 has a first web facing side 2202 and a second oppositely facing side 2204. The web support apparatus 2200 is viewed with the first web facing side 2202 toward the viewer in FIG. 7. The first web facing side 2202 comprises a first web contacting surface and a second web contacting surface.

In FIGS. 7 and 8, the first web contacting surface is a first felt surface 2230 of the felt layer 2220. The first felt surface 2230 disposed at a first elevation 2231. The first felt surface 2230 is a web contacting felt surface. The felt layer 2220 also has oppositely facing second felt surface 2232.

The second web contacting surface is provided by the web patterning layer 2250. The web patterning layer 2250, which is joined to the felt layer 2220, has a web contacting top surface 2260 at a second elevation 2261. The difference between the first elevation 2231 and the second elevation 2261 is less than the thickness of the paper web when the paper web is transferred to the web support apparatus 2200. The surfaces 2260 and 2230 can be disposed at the same elevation, so that the elevations 2231 and 2261 are the same. Alternatively, surface 2260 can be slightly above surface 2230, or surface 2230 can be slightly above surface 2260.

The difference in elevation is greater than or equal to 0.0 mils and less than about 8.0 mils. In one embodiment, the difference in elevation is less than about 6.0 mils (0.15 mm), more preferably less than about 4.0 mils (0.10 mm), and most preferably less than about 2.0 mil (0.05 mm), in order to maintain a relatively smooth surface 24.

Figure 9:
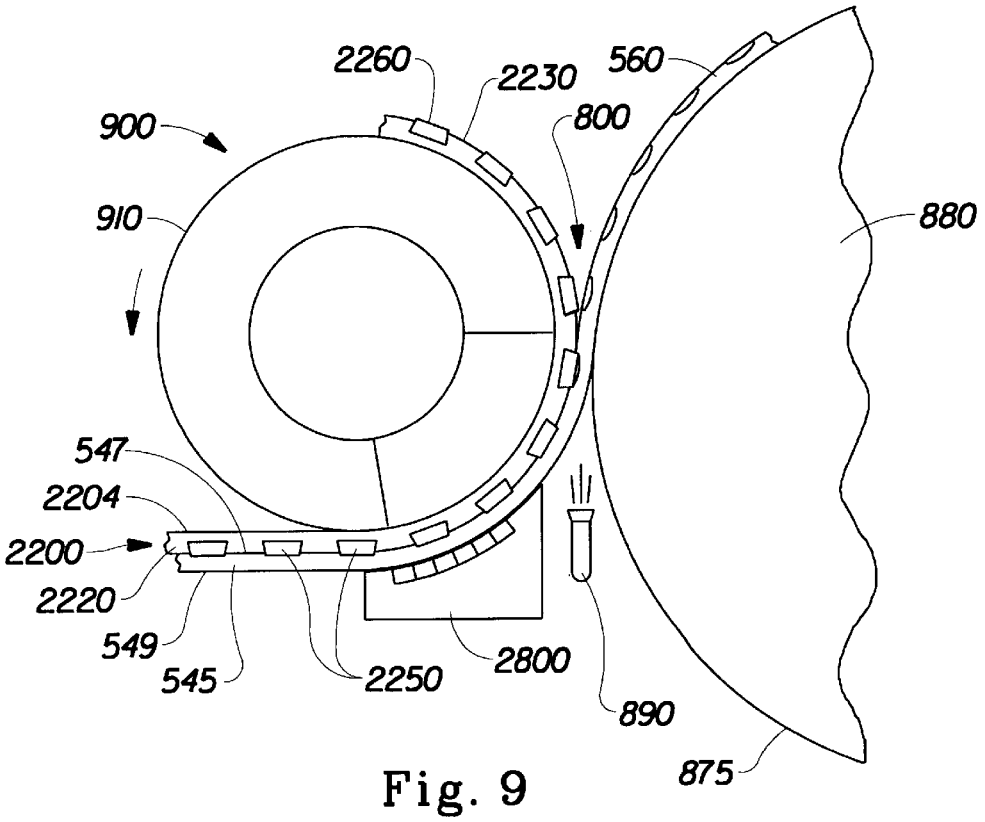
FIG. 9 is a schematic illustration showing a paper web being transferred from the web support apparatus of FIG. 7 to a Yankee dryer.

The dewatering felt layer 2220 is water permeable and is capable of receiving and containing water pressed from a wet web of papermaking fibers. The web patterning layer 2250 is water impervious, and does not receive or contain water pressed from a web of papermaking fibers. The web patterning layer 2250 can have a continuous web contacting top surface 2260, as shown in FIGS. 8 and 9. Alternatively, the web patterning layer can be discontinuous or semicontinuous.

The web patterning layer 2250 preferably comprises a photosensitive resin which can be deposited on the first surface 2230 as a liquid and subsequently cured by radiation so that a portion of the web patterning layer 2250 penetrates, and is thereby securely bonded to, the first felt surface 2230. The web patterning layer 2250 preferably does not extend through the entire thickness of the felt layer 2220, but instead extends through less than about half the thickness of the felt layer 2220 to maintain the flexibility and compressibility of the web support apparatus 2200, and particularly the flexibility and compressibility of the felt layer 2220.

A suitable dewatering felt layer 2220 comprises a nonwoven batt 2240 of natural or synthetic fibers joined, such as by needling, to a support structure formed of woven filaments 2244. Suitable materials from which the nonwoven batt can be formed include but are not limited to natural fibers such as wool and synthetic fibers such as polyester and nylon. The fibers from which the batt 2240 is formed can have a denier of between about 3 and about 20 grams per 9000 meters of filament length.

The felt layer 2220 can have a layered construction, and can comprise a mixture of fiber types and sizes. The felt layer 2220 is formed to promote transport of water received from the web away from the first felt surface 2230 and toward the second felt surface 2232. The felt layer 2220 can have finer, relatively densely packed fibers disposed adjacent the first felt surface 2230. The felt layer 2220 preferably has a relatively high density and relatively small pore size adjacent the first felt surface 2230 as compared to the density and pore size of the felt layer 2220 adjacent the second felt surface 2232, such that water entering the first surface 2230 is carried away from the first surface 2230.

The dewatering felt layer 2220 can have a thickness greater than about 2 mm. In one embodiment the dewatering felt layer 2220 can have a thickness of between about 2 mm and about 5 mm.

PCT Publications WO 96/00812 published Jan. 11, 1996, WO 96/25555 published Aug. 22, 1996, WO 96/25547 published Aug. 22, 1996, all in the name of Trokhan et al.; U.S. patent application Ser. No. 08/701,600 "Method for Applying a Resin to a Substrate for Use in Papermaking" filed Aug. 22, 1996; U.S. patent application Ser. No. 08/640,452 "High Absorbence/Low Reflectance Felts with a Pattern Layer" filed Apr. 30, 1996 (now U.S. Pat. No. 5,693,187); and U.S. patent application Ser. No. 08/672,293 "Method of Making Wet Pressed Tissue Paper with Felts Having Selected Permeabilities" filed Jun. 28, 1996 (now U.S. Pat. No. 5,776,307) are incorporated herein by reference for the purpose of disclosing applying a photosensitive resin to a dewatering felt and for the purpose of disclosing suitable dewatering felts.

The dewatering felt layer 2220 can have an air permeability of less than about 200 standard cubic feet per minute (scfm), where the air permeability in scfin is a measure of the number of cubic feet of air per minute that pass through a one square foot area of a felt layer, at a pressure differential across the dewatering felt thickness of about 0.5 inch of water. In one embodiment, the dewatering felt layer 2220 can have an air permeability of between about 5 and about 200 scfm, and more preferably less than about 100 scfm.

The dewatering felt layer 2220 can have a basis weight of between about 800 and about 2000 grams per square meter, an average density (basis weight divided by thickness) of between about 0.35 gram per cubic centimeter and about 0.45 gram per cubic centimeter. The air permeability of the web support apparatus 2200 is less than or equal to the permeability of the felt layer 2220.

One suitable felt layer 2220 is an Amflex 2 Press Felt manufactured by the Appleton Mills Company of Appleton, Wis. The felt layer 2220 can have a thickness of about 3 millimeter, a basis weight of about 1400 gm/square meter, an air permeability of about 30 scfm, and have a double layer support structure having a 3 ply multifilament top and bottom warp and a 4 ply cabled monofilament crossmachine direction weave. The batt 2240 can comprise polyester fibers having a denier of about 3 at the first surface 2230, and a denier of between about 10–15 in the batt substrate underlying the first surface 2230.

The web support apparatus 2200 shown in FIG. 7 has a web patterning layer 2250 having a continuous network web contacting top surface 2260 having a plurality of discrete openings 2270 therein. In FIG. 7, the shape of the openings 2270 is substantially the same as the shape of the perimeter of the protuberances 1659, as viewed in FIG. 5.

Suitable shapes for the openings 2270 include, but are not limited to circles, ovals, polygons, irregular shapes, or mixtures of these. The projected surface area of the continuous network top surface 2260 can be between about 5 and about 75 percent of the projected area of the web support apparatus 2200 as viewed in FIG. 7, and is preferably between about 25 percent and about 50 percent of the projected area of the apparatus 2200.

The continuous network top surface 2260 can have between about 8 and about 350 discrete openings 2270 per square inch of the projected area of the apparatus 2200 as viewed in FIG. 7. In one embodiment, the continuous network top surface 2260 can have about 60 to about 80 discrete openings 2270 per square inch.

The discrete openings 2270 can be bilaterally staggered in the machine direction (MD) and cross-machine direction (CD) as described in U.S. Pat. No. 4,637,859 issued Jan. 20, 1987, which patent is incorporated herein by reference. Alternatively, the other photopolymer patterns can be used for providing different patterns of densification of the web.

The web is transferred to the web support apparatus 2200 such that the first face 547 of the transferred web 545 is supported on and conformed to the side 2202 of the apparatus 2200, with parts of the web 545 supported on the surface 2260 and parts of the web supported on the felt surface 2230. The second face 549 of the web is maintained in a substantially smooth, macroscopically monoplanar configuration.

Referrring to FIG. 8, the elevation difference between the surface 2260 and the surface 2230 of the web support apparatus 2200 is sufficiently small that the second face of the web remains substantially smooth and macroscopically monoplanar when the web is transferred to the apparatus 2200. In particular, the difference in elevation 2261 of the surface 2260 and elevation 2231 of the surface 2230 should be smaller than the thickness of the embryonic web at the point of transfer.

The steps of transferring the embryonic web 543 to the apparatus 2200 can be provided, at least in part, by applying a differential fluid pressure to the embryonic web 543. Referring to FIG. 4, the embryonic web 543 can be vacuum transferred from the forming element 1600 to the apparatus 2200 by a vacuum source 600 depicted in FIG. 4, such as a vacuum shoe or a vacuum roll. One or more additional vacuum sources 620 can also be provided downstream of the embryonic web transfer point to provide further dewatering.

The web 545 is carried on the apparatus 2200 in the machine direction (MD in FIG. 4) to a nip 800 provided between a vacuum pressure roll 900 and a hard surface 875 of a heated Yankee dryer drum 880. Referring to FIG. 11, a steam hood 2800 can be positioned just upstream of the nip 800. The steam hood can be used to direct steam onto the surface 549 of the web 545 as the surface 547 of the web 545 is carried over the vacuum pressure roll 900.

The steam hood 2800 is mounted opposite a section of the vacuum providing portion 920 of the vacuum pressure roll. The vacuum providing portion 920 draws the steam into the web 545 and the felt layer 2220. The steam provided by steam hood 2800 heats the water in the paper web 545 and the felt layer 2220, thereby reducing the viscosity of the water in the web and the felt layer 2220. Accordingly, the water in the web and the felt layer 2220 can be more readily removed by the vacuum provided by roll 900.

The steam hood 2800 can provide about 0.3 pound of saturated steam per pound of dry fiber at a pressure of less than about 15 psi. The vacuum providing portion 920 provides a vacuum of between about 1 and about 15 inches of Mercury, and preferably between about 3 and about 12 inches of Mercury at the surface 2204.

A suitable vacuum pressure roll 900 is a suction pressure roll manufactured by Winchester Roll Products. A suitable steam hood 2800 is a model D5A manufactured by Measurex-Devron Company of North Vancouver, British Columbia, Canada.

The vacuum providing portion 920 is in communication with a source of vacuum (not shown). The vacuum providing portion 920 is stationary relative to the rotating surface 910 of the roll 900. The surface 910 can be a drilled or grooved surface through which vacuum is applied to the surface 2204. The surface 910 rotates in the direction shown in FIG. 11. The vacuum providing portion 920 provides a vacuum at the surface 2204 of the web support apparatus 2200 as the web and apparatus 2200 are carried through the steam hood 2800 and through the nip 800. While a single vacuum providing portion 920 is shown, in other embodiments it may be desirable to provide separate vacuum providing portions, each providing a different vacuum at the surface 2204 as the apparatus 2200 travel around the roll 900.

The Yankee dryer typically comprises a steam heated steel or iron drum. Referring to FIG. 11, the web 545 is carried into the nip 800 supported on the apparatus 2200, such that the substantially smooth second face 549 of the web can be transferred to the surface 875. Upstream of the nip, prior to the point where the web is transferred to the surface 875, a nozzle 890 applies an adhesive to the surface 875.

The adhesive can be a polyvinyl alchohol based adhesive. Alternatively, the adhesive can be CREPTROL® brand adhesive manufactured by Hercules Company of Wilmington Del. Other adhesives can also be used. Generally, for embodiments where the web is transferred to the Yankee drum 880 at a consistency greater than about 45 percent, a polyvinyl alchohol based creping adhesive can be used. At consistencies lower than about 40 percent, an adhesive such as the CREPTROL® adhesive can be used.

The adhesive can be applied to the web directly, or indirectly (such as by application to the Yankee surface 875), in a number of ways. For instance, the adhesive can be sprayed in micro-droplet form onto the web, or onto the Yankee surface 875. Alternatively, the adhesive could also be applied to the surface 875 by a transfer roller or brush. In yet another embodiment, the creping adhesive could be added to the paper furnish at the wet end of the papermachine, such as by adding the adhesive to the paper furnish in the headbox 500. From about 2 pounds to about 4 pounds of adhesive can be applied per ton of paper fibers dried on the Yankee drum 880.

As the web is carried on the apparatus 2200 through the nip 800, the vacuum providing portion 920 of the roll 900 provides a vacuum at the surface 2204 of the web support apparatus 2200. Also, as the web is carried on the apparatus 2200 through the nip 800, between the vaccuum pressure roll 900 and the dryer surface 800, the web patterning layer 2250 of the web support apparatus 2200 imparts the pattern corresponding to the surface 2260 to the first face 547 of the web 545. Because the second face 549 is a substantially smooth, macroscopically monoplanar face, substantially all of the of the second surface 549 is positioned against, and adhered to, the dryer surface 875 as the web is carried through the nip 800. As the web is carried through the nip, the second face 549 is supported against the smooth surface 875 to be maintained in a substantially smooth, macroscopically monoplanar configuration. Accordingly, a predetermined pattern can be imparted to the first face 547 of the web 545, while the second face 549 remains substantially smooth. The web 545 preferably has a consistency of between about 20 percent and about 60 percent when the web 545 is transferred to the surface 875 and the pattern of surface 2260 is imparted to the web to selectively densify the web. The pattern of the surface 2260 is imparted to the web to provide the continuous network region 110 and the discrete, relatively low density regions 130 shown in FIGS. 1–3.

Without being limited by theory, it is believed that, as a result of having substantially all of the second face 549 positioned against the Yankee surface 875, drying of the web 545 on the Yankee is more efficient than would be possible with a web which has only selective portions of the second face against the Yankee.

The final step in forming the paper structure 20 comprises creping the web 545 from the surface 875 with a doctor blade 1000, as shown in FIG. 4. Without being limited by theory, it is believed that the energy imparted by the doctor blade 1000 to the web 545 bulks, or de-densifies, at least some portions of the web, especially those portions of the web which are not imprinted by the web patterning surface 2260, such as relatively low density regions 130 and 280. Accordingly, the step of creping the web from the surface 875 with the doctor blade 1000 provides a web having a first, compacted, relatively thinner region corresponding to the pattern imparted to the first face of the web, and a second relatively thicker region. In one embodiment, the doctor blade has a bevel angle of about 20 degrees and is positioned with respect to the Yankee dryer to provide an impact angle of about 76 degrees.

The following examples illustrate the practice of the present invention but are not intended to be limiting thereof.

EXAMPLE 1

First, a 3% by weight aqueous slurry of Northern Softwood Kraft (NSK) fibers is made using a conventional re-pulper. A 2% solution of the temporary wet strength resin (i.e., PAREZ® 750 marketed by American Cyanamid corporation of Stanford, Conn.) is added to the NSK stock pipe at a rate of 0.2% by weight of the dry fibers. The NSK slurry is diluted to about 0.2% consistency at the fan pump. Second, a 3% by weight aqueous slurry of Eucalyptus fibers is made up using a conventional re-pulper. A 2% solution of the debonder (i.e., Adogen® SDMC marketed by Witco Corporation of Dublin, Ohio) is added to one of the Eucalyptus stock pipe at a rate of 0.1% by weight of the dry fibers. The Eucalyptus slurry is diluted to about 0.2% consistency at the fan pump.

The treated furnish streams are mixed in the headbox and deposited onto the forming element 1600. Dewatering occurs through the forming element 1600 and is assisted by a deflector and vacuum boxes. The forming element 1600 includes protuberances 1659 joined to a reinforcing structure 1657. The reinforcing structure is a wire manufactured by Appleton Wire of Appleton, Wisconsin, having a triple-layer square weave configuration having 90 machine-direction and 72 cross-machine-direction monofilaments per inch, respectively. The monofilament diameter ranges from about 0.15 mm to about 0.20 mm. The wire reinforcing structure has an air permeability of about 1050 scfm.

The forming element 1600 has about 100 protuberances 1659 per square inch. The protuberances 1659 have the shape shown in FIG. 5, and have an MD (machine direction) dimension A of 0.105 inch, a CD (cross machine direction) dimension B of about 0.074 inch, a machine direction spacing C of 0.136 inch, and a cross-machine direction spacing D of 0.147 inch. The minimum spacing E between adjacent protuberances can be 0.029 inch. The protuberances 1659 extend a height H of about 0.008 inch. The apertures 1663 have an elliptical shape with a major axis parallel to the machine direction of about 0.052 inch and a minor axis of about 0.037 inch.

The top surface of the protuberances 1659 provide about 35 percent of the projected area of the forming element 1600, as viewed in FIG. 5. The apertures 1663 provide about 15 percent of the projected area of the forming element 1600 as viewed in FIG. 5. The annuluses 1665 provide about 50 percent of the projected area of the forming element 1600 as viewed in FIG. 5.

The embryonic web is transferred from the forming element 1600, at a fiber consistency of about 10% at the point of transfer, to a web support apparatus 2200 having a dewatering felt layer 2220 and a photosensitive resin web patterning layer 2250. The dewatering felt 2220 is a Amflex 2 Press Felt manufactured by Albany International of Albany, N.Y. The felt 2220 comprises a batt of polyester fibers. The batt has a surface denier of 3, and substrate denier of 10–15. The felt layer 2220 has a basis weight of 1436 gm/square meter, a caliper of about 3 millimeter, and an air permeability of about 30 to about 40 scfm. The web patterning layer 2250 comprises a continuous network web contacting surface 2260 with about 69 discrete openings 2270 per square inch, the openings having the shape shown in FIG. 7. The web patterning layer 2250 has a projected area equal to about 35 percent of the projected area of the web support apparatus 2200. The difference in elevation 2261 of the surface 2260 and the elevation 2231 of the 2230 of the felt layer is about 0.008 inch (0.205 millimeter).

The embryonic web is transferred to the web support apparatus 2200 to form a generally monoplanar web 545. Transfer and deflection are provided at the vacuum transfer point with a pressure differential of about 20 inches of mercury. Further dewatering is accomplished by vacuum assisted drainage until the web has a fiber consistency of about 25%. The web 545 is carried to the nip 800. The vacuum roll 900 has a compression surface 910 having a hardness of about 60 P&J. The web 545 is compacted against the compaction surface 875 of the Yankee dryer drum 880 by pressing the web 545 and the web support apparatus 2200 between the compression surface 910 and the Yankee dryer drum 880 surface at a compression pressure of about 200 psi. A polyvinyl alcohol based creping adhesive is used to adhere the compacted web to the Yankee dryer. The fiber consistency is increased to at least about 90% before dry creping the web with a doctor blade. The doctor blade has a bevel angle of about 20 degrees and is positioned with respect to the Yankee dryer to provide an impact angle of about 76 degrees; the Yankee dryer is operated at about 800 fpm (feet per minute) (about 244 meters per minute). The dry web is formed into roll at a speed of 650 fpm (200 meters per minutes).

The web is converted into a homogenous, two-ply bath tissue paper. The two-ply toilet tissue paper has a basis weight of about 25 pounds per 3000 square feet, and contains about 0.2% of the temporary wet strength resin and about 0.1% of the debonder. The resulting two-ply tissue paper is bulky, soft, absorbent, aesthetics and is suitable for use as bath or facial tissues.

EXAMPLE 2

Prophetic Example:

According to this prophetic example, a 3% by weight aqueous slurry of Northern Softwood Kraft (NSK) fibers is made using a conventional re-pulper. A 2% solution of the temporary wet strength resin (i.e., PAREZ® 750 marketed by American Cyanamid corporation of Stanford, Conn.) is added to the NSK stock pipe at a rate of 0.2% by weight of the dry fibers. The NSK slurry is diluted to about 0.2% consistency at the fan pump.

Second, a 3% by weight aqueous slurry of Eucalyptus fibers is made up using a conventional re-pulper. A 2% solution of the debonder (i.e., Adogen® SDMC marketed by Witco Corporation of Dublin, Ohio) is added to one of the Eucalyptus stock pipe at a rate of 0.5% by weight of the dry fibers. This first Eucalyptus slurry is diluted to about 0.2% consistency at the fan pump.

Third, a 3% by weight aqueous slurry of Eucalyptus fibers is made up using a conventional re-pulper. A 2% solution of the debonder (i.e., Adogen® SDMC marketed by Witco Corporation of Dublin, Ohio) and a 2% solution of dry strength binder (i.e., Redibond® 5320 marketed by National Starch and Chemical corporation of New York, N.Y.) are added to the Eucalyptus stock pipe at a rate of 0.1% by weight of the dry fibers. This second Eucalyptus slurry is diluted to about 0.2% consistency at the fan pump.

Three individual treated furnish streams are formed from the above slurries. Stream 1 is a mixture of the NSK slurry and the second Eucalyptus slurry, stream 2 is formed from the first eucalyptus slurry (100 percent debonded Eucalyptus), and stream 3 is a mixture of the NSK stream and the first Eucalyptus slurry. The three furnish streams are deposited onto the forming element 1600 to form a three layer web having outer layers comprising a mixture of NSK and Eucalyptus and an inner layer comprising debonded Eucalyptus.

Dewatering occurs through the forming element 1600 and is assisted by a deflector and vacuum boxes. The forming element reinforcing structure 1657 is a wire, manufactured by Appleton Wire of Appleton, Wisconsin, having a triple-layer square weave configuration having 90 machine-direction and 72 cross-machine-direction monofilaments per inch, respectively. The monofilament diameter ranges from about 0.15 mm to about 0.20 mm. The reinforcing structure has an air permeability of about 1050 scfm.

The protuberances 1659 have a size and shape are shaped as shown in FIG. 5. The protuberances have the same general dimensions as set forth above for Example 1, except that the apertures 1663 are reduced in size to provide only about 10 percent of the projected area as viewed in FIG. 5. The height H shown in FIG. 6 is about 0.008 inch (0.152 millimeter). The size of the apertures is reduced to provide a web having generally two basis_weight regions 40 and 60, and without an intermediate basis weight region.

The embryonic wet web is transferred from the forming element 1600 at a fiber consistency of about 10% at the point of transfer, to a web support apparatus 2200 having a dewatering felt layer 2220 and a photosensitive resin web patterning layer 2250. The dewatering felt 2220 is a Amflex 2 Press Felt manufactured by Albany International of Albany, N.Y. The felt 2220 comprises a batt of polyester fibers. The batt has a surface denier of 3, a substrate denier of 10–15. The felt layer 2220 has a basis weight of 1436 gm/square meter, a caliper of about 3 millimeter, and an air permeability of about 30 to about 40 scfm.

The web patterning layer 2250 comprises a continuous network web contacting surface 2260 with discrete openings 2270 having the shape shown in FIG. 7. The web patterning layer 2250 has a projected area equal to about 35 percent of the projected area of the web support apparatus 2200. The difference in elevation 2261 of the surface 2260 and the elevation 2231 of the 2230 of the felt layer is about 0.008 inch (0.205 millimeter).

The embryonic web is transferred to the web support apparatus 2200 to form a generally monoplanar web 545. Transfer and deflection are provided at the vacuum transfer point with a pressure differential of about 20 inches of mercury. Further dewatering is accomplished by vacuum assisted drainage until the web has a fiber consistency of about 25%. The web 545 is carried to the nip 800. The vacuum roll 900 has a compression surface 910 having a hardness of about 60 P&J. The web 545 is compacted against the compaction surface 875 of the Yankee dryer drum 880 by pressing the web 545 and the web support apparatus 2200 between the compression surface 910 and the Yankee dryer drum 880 surface at a compression pressure of about 200 psi. A polyvinyl alcohol based creping adhesive is used to adhere the compacted web to the Yankee dryer. The fiber consistency is increased to at least about 90% before dry creping the web with a doctor blade. The doctor blade has a bevel angle of about 20 degrees and is positioned with respect to the Yankee dryer to provide an impact angle of about 76 degrees; the Yankee dryer is operated at about 800 fpm (feet per minute) (about 244 meters per minute). The dry web is formed into roll at a speed of 650 fpm (200 meters per minutes).

The web is converted into a 3-layer two-ply bath tissue paper. The two-ply bath tissue paper has a basis weight of about 25 pounds per 3000 square feet, and contains about 0.2% of the temporary wet strength resin and about 0.1% of the debonder. The resulting two-ply tissue paper is bulky, soft, absorbent, aesthetic and is suitable for use as bath or facial tissues.

TEST METHODS:

Surface Smoothness:

The surface smoothness of a side of a paper web is measured based upon the method for measuring physiological surface smoothness (PSS) set forth in the 1991 International Paper Physics Conference, TAPPI Book 1, article entitled "Methods for the Measurement of the Mechanical Properties of Tissue Paper" by Ampulski et al. found at page 19, which article is incorporated herein by reference. The PSS measurement as used herein is the point by point sum of amplitude values as described in the above article. The measurement procedures set forth in the article are also generally described in U.S. Pat. No. 4,959,125 issued to Spendel and U.S. Pat. No. 5,059,282 issued to Ampulski et al, which patents are incorporated herein by reference.

For purposes of testing the paper samples of the present invention, the method for measuring PSS in the above article is used to measure surface smoothness, with the following procedural modifications:

Instead of importing digitized data pairs (amplitude and time) into SAS software for 10 samples, as described in the above article, the Surface Smoothness measurement is made by acquiring, digitizing, and statistically processing data for the 10 samples using LABVIEW brand software available from National Instruments of Austin, Tex. Each amplitude spectrum is generated using the "Amplitude and Phase Spectrum.vi" module in the LABVIEW software package, with "Amp Spectrum Mag Vrms" selected as the output spectrum. An output spectrum is obtained for each of the 10 samples.

Each output spectrum is then smoothed using the following weight factors in LABVIEW: 0.000246, 0.000485, 0.00756, 0.062997. These weight factors are selected to imitate the smoothing provided by the factors 0.0039, 0.0077, 0.120, 1.0 specified in the above article for the SAS program.

After smoothing, each spectrum is filtered using the frequency filters specified in the above article. The value of PSS, in microns, is then calculated as described in the above mentioned article, for each individually filtered spectrum. The Surface Smoothness of the side of a paper web is the average of the 10 PSS values measured from the 10 samples taken from the same side of the paper web. Similarly, the Surface Smoothness of the opposite side of the paper web can be measured. The smoothness ratio is obtained by dividing the higher value of Surface Smoothness, corresponding to the more textured side of the paper web, by the lower value of Surface Smoothness, corresponding to the smoother side of the paper web.

Basis Weight:

The basis weight of the web (macro basis weight) is measured using the following procedure.

The paper to be measured is conditioned at 71–75 degrees Fahrenheit at 48 to 52 percent relative humidity for a minimum of 2 hours. The conditioned paper is cut to provide twelve samples measuring 3.5 inch by 3.5 inch. The samples are cut, six samples at a time, with a suitable pressure plate cutter, such as a Thwing-Albert Alfa Hydraulic Pressure Sample Cutter, Model 240-10. The two six sample stacks are then combined into a 12 ply stack and conditioned for at least 15 additional minutes at 71 to 75 F and 48 to 52 percent humidity.

The 12 ply stack is then weighed on a calibrated analytical balance. The balance is maintained in the same room in which the samples were conditioned. A suitable balance is made by Sartorius Instrument Company, Model A200S. This weight is the weight in grams of a 12 ply stack of the paper, each ply having an area of 12.25 square inches.

The basis weight of the paper web (the weight per unit area of a single ply) is calculated in units of pounds per 3,000 square feet, using the following equation:

Weight of 12 ply stack (grams)×3000×144 sq inch per sq ft.

$$(453.6\ \text{gm/lb})\times(12\ \text{plies})\times(12.25\ \text{sq. in. per ply})$$

or simply:

$$\text{Basis Weight (lb/3,000 ft}^2)=\text{Weight of 12 ply stack (gm)}\times 6.48$$

Measurement of Web Support Apparatus Elevations:

The elevation difference between the elevation 2231 of the first felt surface and the elevation 2261 of the web contacting surface 2260 is measured using the following procedure. The web support apparatus is supported on a flat horizontal surface with the web patterning layer facing upward. A stylus having a circular contact surface of about 1.3 square millimeters and a vertical length of about 3 millimeters is mounted on a Federal Products dimensioning gauge (model 432B-81 amplifier modified for use with an EMD-4320 WI breakaway probe) manufactured by the Federal Products Company of Providence, R.I. The instrument is calibrated by determining the voltage difference between two precision shims of known thickness which provide a known elevation difference. The instrument is zeroed at an elevation slightly lower than the first felt surface 2230 to insure unrestricted travel of the stylus. The stylus is placed over the elevation of interest and lowered to make the measurement. The stylus exerts a pressure of about 0.24 grams/square millimeter at the point of measurement. At least three measurements are made at each elevation. The measurements at each elevation are averaged. The difference between the average values is the calculated to provide the elevation difference.

What is claimed is:

1. A non-through air dried paper web comprising at least two regions of different density disposed in a first nonrandom, repeating pattern, and at least two regions of different basis weight disposed in a second nonrandom, repeating pattern different from said first repeating pattern.

2. The paper web of claim 1 wherein the at least two regions of different density comprise a relatively high density, essentially continuous network region.

3. The paper web of claim 2 wherein the at least two regions of different density comprise a plurality of discrete, spaced apart relatively low density regions dispersed throughout the relatively high density, essentially continuous network region.

4. The paper web of claim 3 wherein the at least two regions of different basis weight comprise a relatively high basis weight, essentially continuous network region.

5. The paper web of claim 4 wherein the at least two regions of different basis weight comprise a plurality of discrete relatively low basis weight regions dispersed throughout the relatively high basis weight continuous network.

6. The paper web of claim 5 comprising at least three regions of different basis weight.

7. The paper web of claim 6 wherein the paper web comprises a plurality of discrete, intermediate basis weight regions, and wherein the intermediate basis weight regions are generally circumscribed by the relatively low basis weight regions.

* * * * *

UNITED STATES PATENT AND TRADEMARK OFFICE

CERTIFICATE OF CORRECTION

PATENT NO. : 6,136,146
DATED : October 24, 2000
INVENTOR(S) : Dean Van Phan et al.

It is certified that error appears in the above-identified patent and that said Letters Patent is hereby corrected as shown below:

Column 1,
Line 25, delete the first occurrence of "Ser. No.".

Column 12,
Line 43, delete "scfin" and insert therefor -- scfm --.

Signed and Sealed this

Eighteenth Day of June, 2002

*Attest:*

*Attesting Officer*

JAMES E. ROGAN
*Director of the United States Patent and Trademark Office*